United States Patent [19]

Browning

[11] Patent Number: 4,790,527

[45] Date of Patent: Dec. 13, 1988

[54] ENTERTAINMENT OR AMUSEMENT STRUCTURE

[75] Inventor: Michael R. Browning, Flinders, Australia

[73] Assignee: Concord St. George Productions Pty. Ltd., Victoria, Australia

[21] Appl. No.: 939,792

[22] PCT Filed: Mar. 5, 1986

[86] PCT No.: PCT/AU86/00051

§ 371 Date: Nov. 5, 1986

§ 102(e) Date: Nov. 5, 1986

[87] PCT Pub. No.: WO86/05114

PCT Pub. Date: Sep. 12, 1986

[30] Foreign Application Priority Data

Mar. 5, 1985 [AU] Australia ..... PG9567
Mar. 8, 1985 [AU] Australia ..... PG9622

[51] Int. Cl.[4] ..... A63J 3/00
[52] U.S. Cl. ..... 272/10; 52/6
[58] Field of Search ..... 372/10; 52/6, 8, 187; 350/117, 125

[56] References Cited

U.S. PATENT DOCUMENTS 1,844,852 2/1932 Harvey .
2,176,554 10/1939 Hardy .
2,304,434 12/1942 Ayres .
2,380,837 7/1945 Gray .
2,710,335 6/1955 Wong ..... 350/117 X
3,210,895 10/1965 Graf ..... 52/6
3,469,837 9/1969 Heilig ..... 350/125 X
3,992,841 11/1976 Ward, Jr. ..... 350/117 X

FOREIGN PATENT DOCUMENTS 0015404 2/1980 European Pat. Off. .
856356 9/1955 Fed. Rep. of Germany ..... 52/6
1004971 4/1952 France .

*Primary Examiner*—Richard J. Apley
*Assistant Examiner*—Robert W. Bahr
*Attorney, Agent, or Firm*—Birch, Stewart, Kolasch, & Birch

[57] ABSTRACT

An entertainment or amusement structure includes a base support, frame structure, elongated walkway supported by the frame and a horizontally disposed cinema screen. A major portion of the walkway is positioned above the screen and enables viewers to see images projected onto the screen. The walkway may be an arcuate form and may be slightly movable to increase the feeling of realism for the viewers. The frame structure may be within an enclosure, an integral part of a building or a skeletal form. The amusement structure is particularly suited for viewing cinematic programs filmed by a wide angle or fish eye lens. A rear projection or front projection system can be used and the screen may be an elongated length of translucent film or material or a plurality of panels fitted in edge-to-edge relation and held by a support.

15 Claims, 9 Drawing Sheets

ENTERTAINMENT OR AMUSEMENT STRUCTURE

This invention relates to an entertainment or amusement structure.

Footage of cinematic programs which is filmed downwardly, using a fish eye or wide angle lens, can create a dramatic visual impact. However, such an impact is diminished in the conventional arrangement of projecting the footage onto a vertical screen, since the viewer is aware that the images on the vertical screen and being viewed horizontally in fact are a representation of what is in reality extended horizontally below the camera. The present invention provides an entertainment or amusement structure which, when used with such footage, enables the footage to be viewed with an enhanced visual impact.

SUMMARY OF THE INVENTION

A structure according to the invention has a frame structure extending upwardly from a base support, a walkway supported by the frame structure, and a horizontally disposed cinema screen. At least a major portion of the walkway is spaced above, and preferably at least in part over, the screen to enable images projected onto the screen to be seen by viewers on the walkway.

The frame structure may be within a building or enclosure, such as at least in part within a dome thereof. In such case, the frame structure may be an integral part of the building. Alternatively, the frame structure may be of skeletal form, and either independent of or partially braced by a covering building or enclosure. Where the frame structure is independent of the building or enclosure, the latter may simply comprise a covering for the frame structure and either be self-supporting or at least partially supported by the frame structure.

The walkway preferably has an arcuate form, or at least includes a portion of such form, so as to enable viewers thereon to move so as to view images projected onto the screen from different angles. In one form, the walkway may extend around a substantially full circumference above the screen, such as in a circular or helical path.

The structure of the invention is particularly suited for viewing cinematic programs filmed using a wide angle or fish eye lens. Such a program is most conveniently filmed from above, using a camera with such lens. The camera, in producing such a program, for example is carried by a helicopter, glider or hot air balloon which is preferably movable on a gimbal mount, or carried by a sky-diver during a descent.

The walkway may be substantially rigidly supported by the frame structure. However, in a preferred arrangement, the walkway may be suspended by ropes, cables or rods secured to the frame structure. In such an arrangement, the ropes, cables or rods can allow a controlled amount of movement of the walkway, such as a swaying movement, thereby tending to increase a feeling of realism for those viewing the images projected onto the screen.

Where the program is of the intended form, i.e. filmed from above using a fish eye or wide angle lens, it is highly desirable that this be projected onto the screen from below by a rear projection system. The structure according to the invention thus most preferably is adapted for rear projection. For this, the screen necessarily is of a type suited to rear projection, while there is sufficient spacing below the screen for the projected beam to pass to the screen over the relatively longer projection path necessary for rear projection compared with front projection. However, while that spacing can be such as to enable positioning of the rear projection system below the screen, this is not essential. Thus, the projector system can be positioned to one side of, and at a lesser distance below, the screen; with an inclined mirror below the screen reflecting the projected beam upwardly to the screen.

The screen, where of a type suited to rear projection, thus is of a suitable translucent material. The screen may comprise at least one layer of such material held horizontally below walkway by suitable support means. However, to minimize disruption to a program in the event of an object being dropped onto the screen by a viewer on the walkway, the screen and/or its support means may be such that at least a portion of the screen can be replaced or such that the entire screen area can be replaced.

In a first arrangement, the screen may comprise a portion of an elongate length of translucent film or sheet material which is disposed horizontally between a supply roll of the material and a take-up roll. In that arrangement, the rolls may maintain tension on the length of material therebetween. Also, edges of the length between the rolls may be outwardly tensioned. In the event of an object falling onto or through the screen, a fresh length of material can be drawn either manually or by motor driven rotation of the take-up roll.

In a second arrangement, the screen may consist of a plurality of panels fitted in edge-to-edge relation and held in such relation by support means. The panels may, for example, be formed of relatively stiff sheeting of translucent material, or of relatively stiff sheeting of transparent material having a translucent fabric or film over one surface thereof. The support means may comprise a frame of skeletal form which supports the panels from below. The frame may comprise thin lengths of inter-connected metal strips with adjacent edges of successive panels being supported on a common strip. The arrangement preferably is such that, in the event of a panel being damaged by an object falling onto or through it, the damaged panel can simply be removed and replaced.

While rear projection is highly desirable, front projection can be employed. This is so, even for a cinema program filmed in the above described manner.

Where front projection is employed, the building or construction of the invention differs principally in that the projector system is one suited to front projection and is positioned above, rather than below the level of the screen. The screen itself may be of the above described forms, except that it will need to be opaque and omnireflective rather than translucent. However, in an alternative arrangement, the screen can comprise a horizontally disposed surface defined by or on a basal structure of the building or construction.

Where the projection is employed, the image cone projected by the projector system onto the screen of course is not visible to viewers on the walkway. This is beneficial in achieving the required enhanced visual impact. However, with front projection, viewers can be aware of the image cone and while a substantially enhanced visual impact still is achieved, it is desirable that the overall arrangement of the building be such that viewer awareness of the image cone is reduced as much as possible. For this purpose, the front projector system preferably is substantially concealed so that light source of the cone emerges from the system at a location which is not directly visible to viewers from any position on the walkway. The projector system preferably is located above at least a major portion of the walkway. Most preferably it is located within a snoot or shroud; the latter, for example, being one which projects below the lower extent of the projector system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

In order that the invention may be further understood, description now is directed to the accompanying drawings which are given by was of illustration only, and thus are not limitative of the present invention, and in which.

DETAILED DESCRIPTION OF THE PREFERRED EMBODIMENTS

Figure 1:
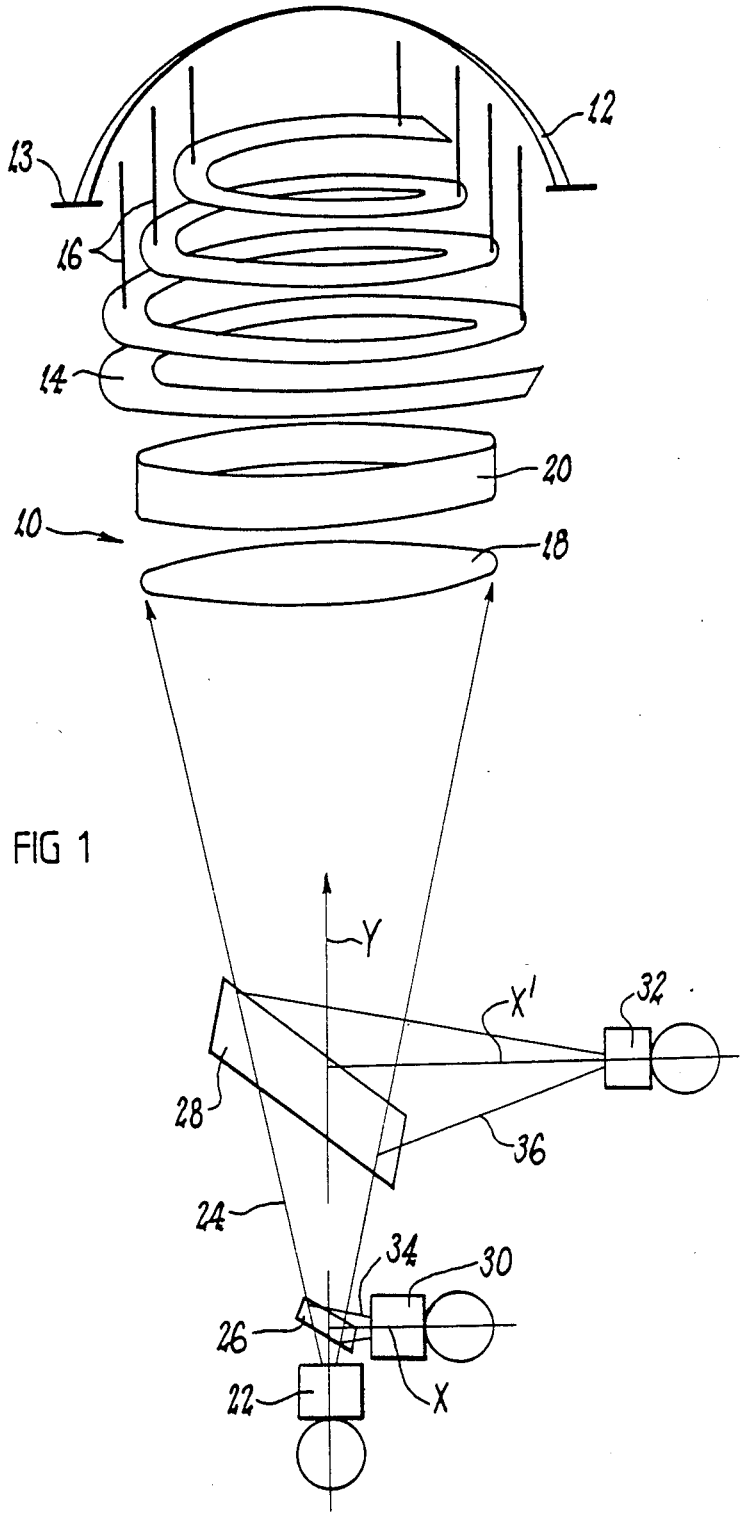
FIG. 1 shows a schematic, exploded view of an entertainment or amusement structure.

The structure 10 of FIG. 1 includes a main support frame 12 from which a spiral viewing platform or walkway 14 is suspended by cables, wires or rods 16. Below platform 14, there is a horizontally disposed translucent screen 18 which may be secured to spacer collar 20. Below screen 18 there is a projector arrangement and, while three alternative arrangements A, B and C are depicted, only one of these normally would be necessary.

Arrangement A has a projector 22 positioned centrally below screen 18 to project an image cone 24, having a vertical axis Y, toward screen 18. Arrangements B and C are similar and a choice between these will depend on the extent of available space below and to the side of screen 18, as well as costs involved in providing an associated, respective reflecting mirror 26,28. Arrangements B, C have respective projectors 30,32 which project respective image cones 34,36 with horizontal axes X,X' toward axis Y; the light of the cones then being reflected toward screen 18, as depicted by the portion of cone 24 above each of respective mirrors 26,28 set at 45° to axis Y. The lateral spacing of projectors 30,32 below screen 18, and their spacing laterally of axis Y, enable use of a smaller mirror 26 compared with mirror 28.

Frame 12 is shown as simply comprising an inverted U-shaped member mounted at each end on convenient base 13. However, it generally would be necessary to have two or more such members, each in a respective vertical plane and joined together in a rigid frame structure, with walkway 14 being suspended from each of those members by cables 16 or the like. Also, walkway 14 can be of forms other than the helical form illustrated.

Figure 2:
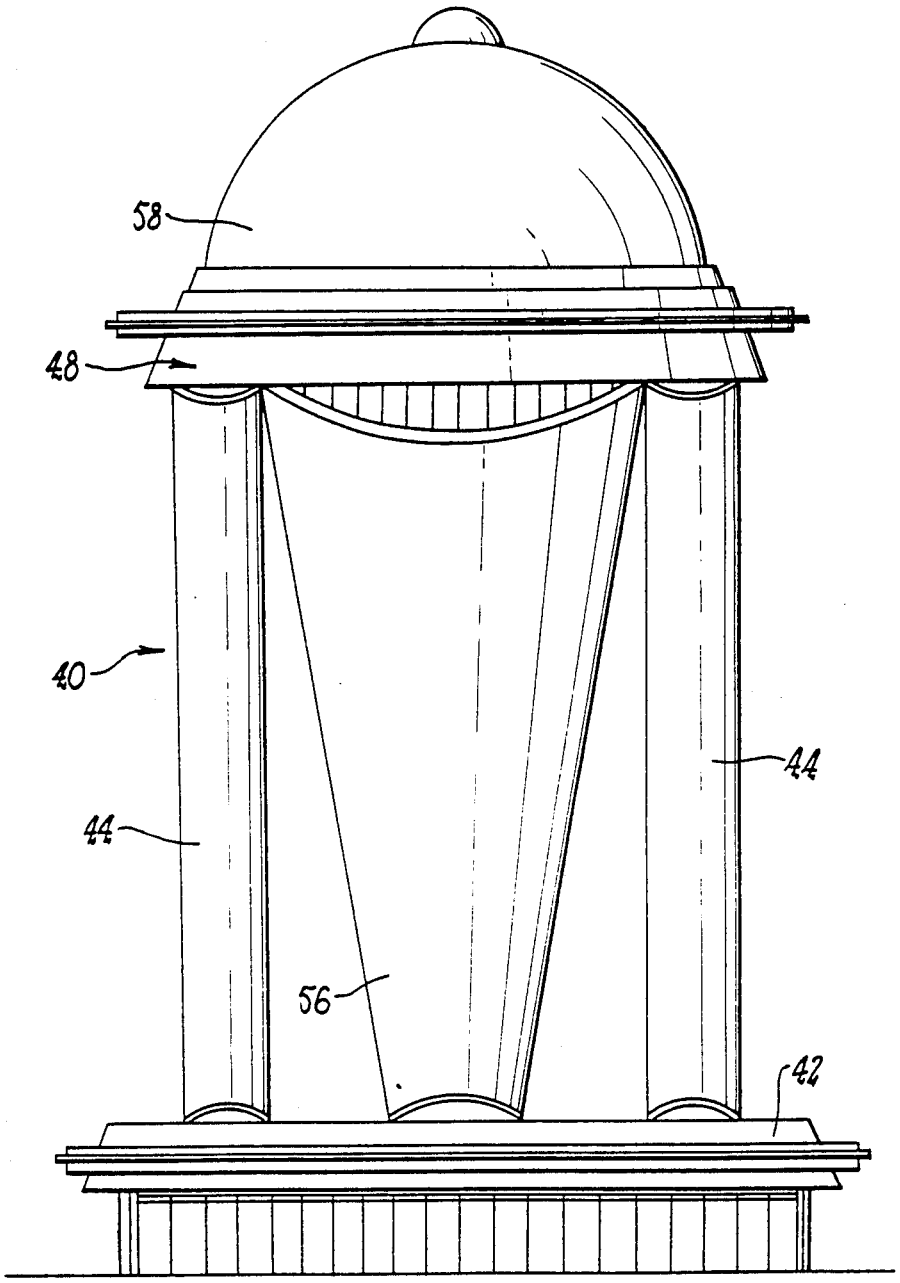
FIG. 2 shows a building or construction incorporating a structure as in FIG. 1.
Figure 10:
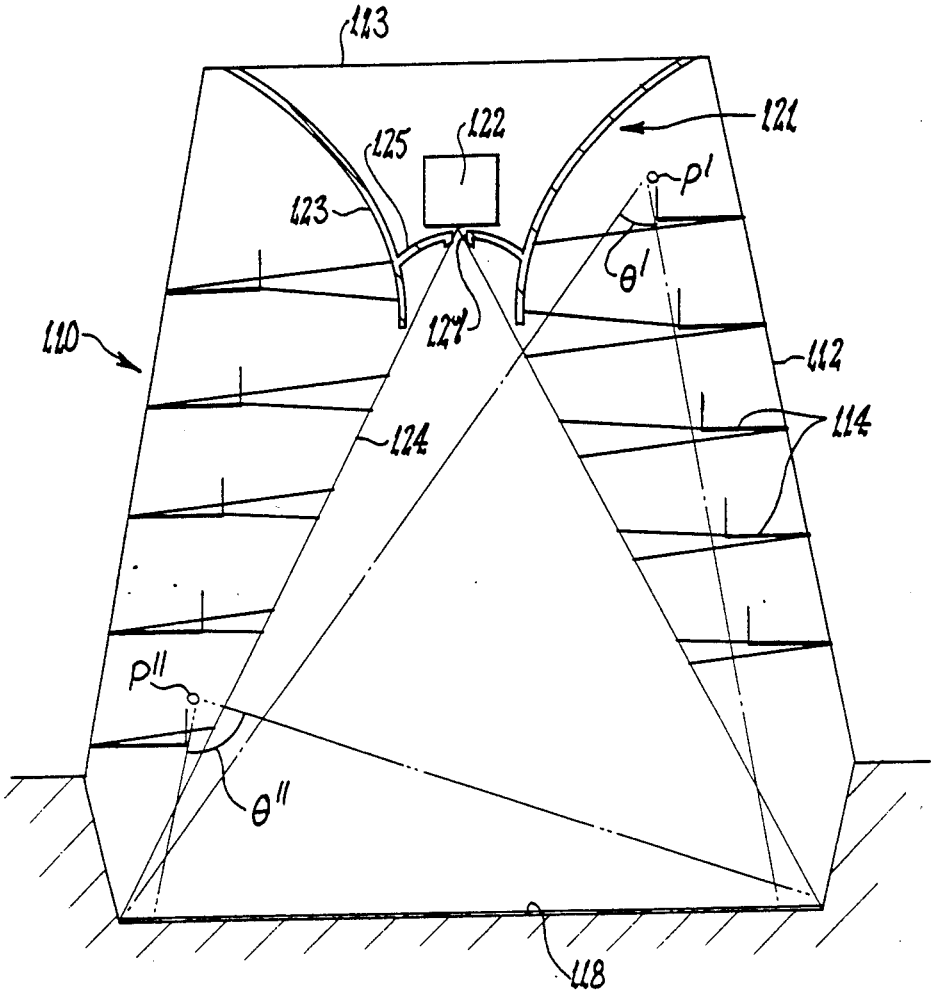
FIG. 10 shows an alternative form of a building or construction.
Figure 11:
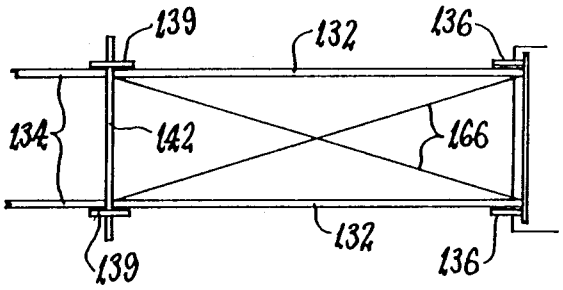
FIGS. 11 to 14 show one form of a structure for a building or construction such as shown in FIG. 1, and its mode of erection.
Figure 12:
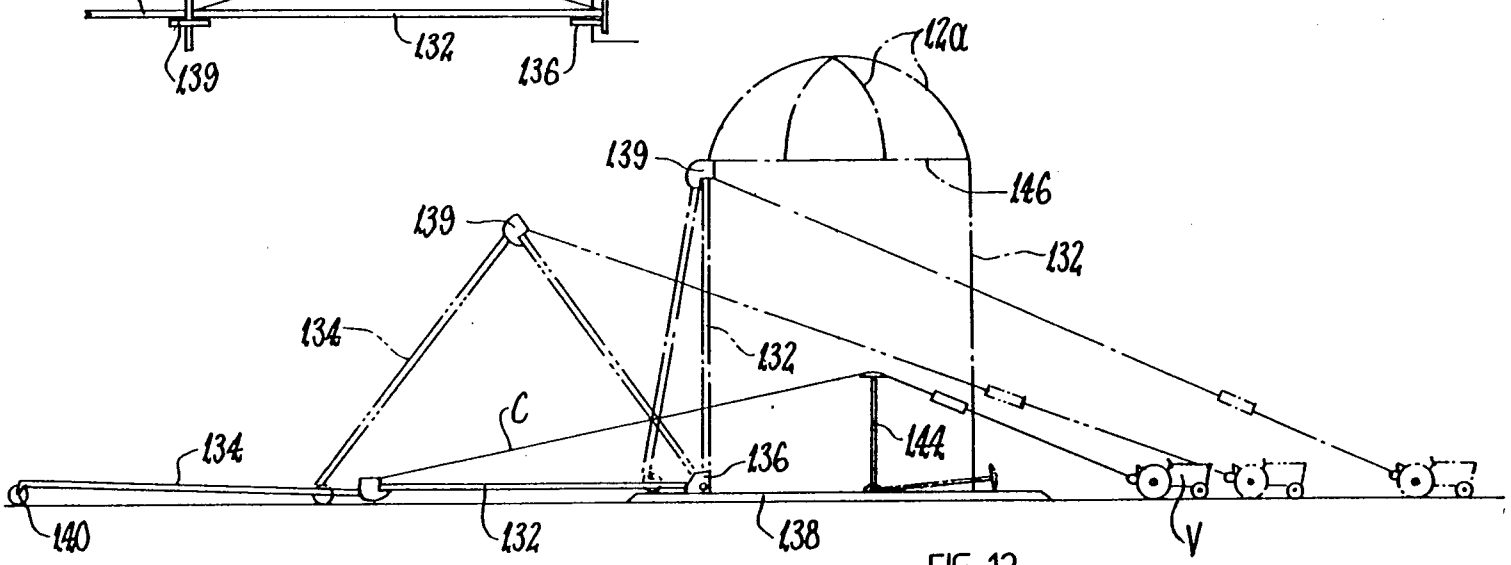

Base 13 is merely schematic. In one arrangement, it depicts a ground level support surface with all of structure 10 below base 13 being in an excavation. In that arrangement, the excavation would be appropriately lined; with there being an excavated entrance enabling access to the lower end of platform 14. In an alternative arrangement, base 13 may be a roof structure of a building, with platform 14 being suspended through an aperture in the roof and at least a portion of structure 10 being below the roof structure and being above ground level. In still further arrangements, base 13 may comprise a column structure such as shown in FIG. 2, or a skeletal frame structure, such as shown in FIGS. 10 to 12. However, in each of these arrangements, frame 12 is covered and the whole periphery of structure 10 is enclosed, in a manner enabling the exclusion of external light when required.

Figure 3:
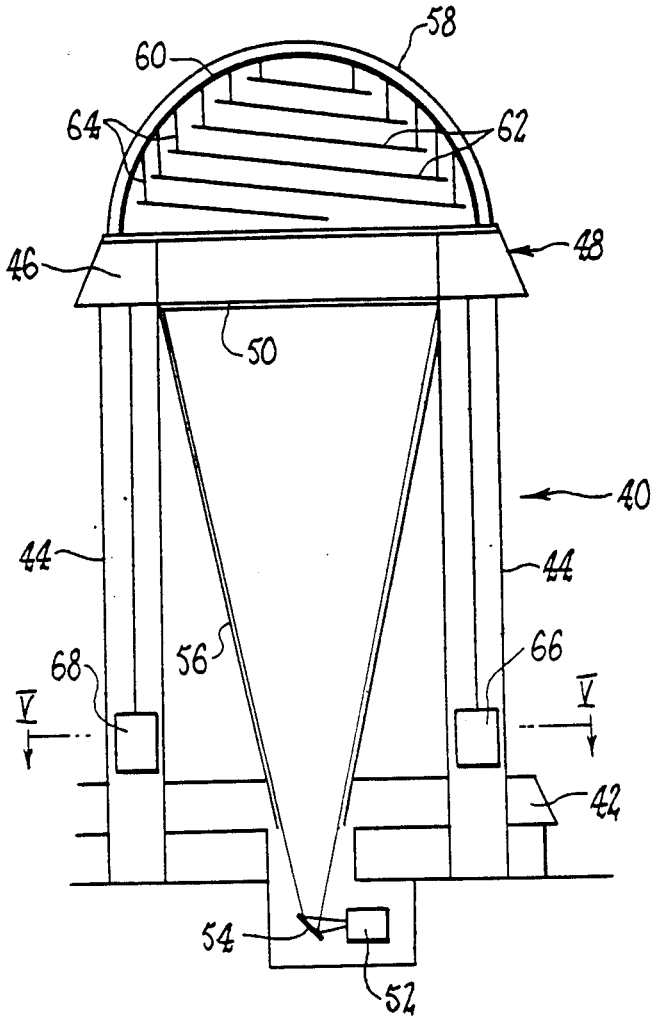
FIG. 3 is a vertical sectional view showing detail of the building or construction of FIG. 2.
Figure 5:
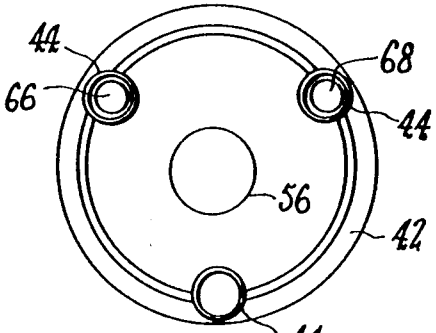
FIG. 5 is a sectional view taken on line V—V of FIG. 3.

FIGS. 2 and 3 show a building or construction 40 for housing a structure, such as in FIG. 1. Building 40 has a ground level building enclosure 42 providing an entrance foyer. Extending upwardly from enclosure 42 there are three hollow columns 44. Two of the columns 44 define lift shafts, with a respective lift movable in each being accessible from within enclosure 42 and from within an annular outer peripheral chamber 46 of an upper building enclosure 48 supported on the upper ends of columns 44.

Upper enclosure 48 has within peripheral chamber 46 thereof a horizontally disposed translucent screen 50. A cinematic program is able to be projected onto screen 50 by a below ground projector 52. The latter is laterally offset from a vertical axis of construction 40, and projects horizontally toward the axis; with the projected beam being reflected along that axis toward screen 50 by 45° mirror 54. In order to minimize the degrading effect of external light, the projected beam passes along a frusto-conical housing 56 extending between enclosures 42,48.

On upper enclosures 48, there is provided a hemispherical dome 58, with a frame structure 60 within dome 58 being supported by enclosure 48. Also within dome 58, there is a helical walkway 62 suspended from frame structure 60 by cables 64. The overall arrangement is such that viewers of a program projected onto screen 50 are able to enter enclosure 42, be elevated by a lift 66 in one column 44 to portion 46 of enclosure 48. From enclosure 48, the viewers then are able to walk onto the lower end of walkway 62 and view the program from that vantage point. While not shown, the lower end of walkway 62 may extend down into chamber 46 of enclosure 48, or there may be a connecting stairway. Alternatively, movement may be in the reverse direction, with viewers passing via a stairway from chamber 46 of enclosure 48, to the upper end of walkway 62.

The arrangement is such that viewers are able to move around walkway 62. Most preferably, viewers pass onto walkway 62 at one end and exit therefrom via the other end. On returning to chamber 46, viewers may return to ground level via lift 68 in another of columns 44.

The foregoing description of FIG. 3 is with reference to an arrangement having relatively tall columns 44. However, FIG. 4 illustrates an alternative arrangement with a lesser overall height.

Figure 4:
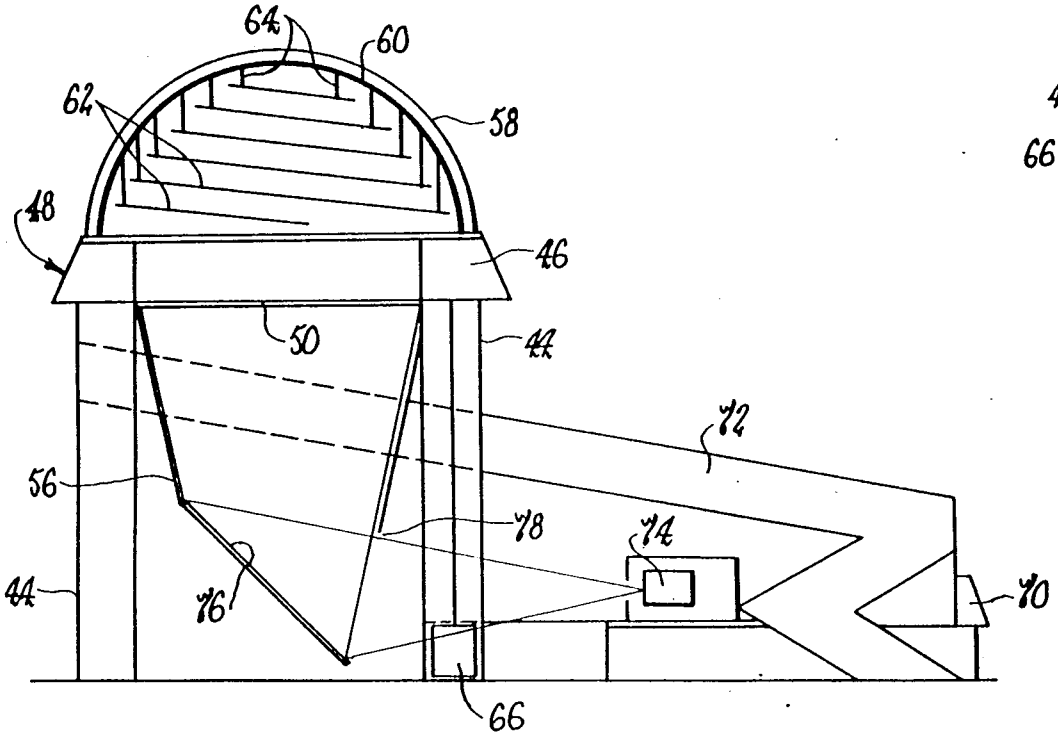
FIG. 4 shows, in a view similar to that of FIG. 3, detail of an alternative building or construction.

In the alternative arrangement of FIG. 4, there is a ground level entrance enclosure 70, from which viewers again are able to pass to chamber 46 via lift 66. However, on exiting from chamber 46, the viewers are able to return to ground level via stairway passage 72. As shown, enclosure 70 extends to one side of enclosure 48, rather than being below the latter as is the case with enclosure 42. Also, a projector 74 is located to one side of enclosure 48, on enclosure 70, and projects its image cone horizontally to a mirror 76 positioned below screen 50 at an angle of 45° so as to reflect the image cone onto the underside of screen 50. The image cone passes from projector 74 to mirror 76 through an opening 78 is frusto-conical housing 56. For the purpose of eliminating incidental light, a laterally extending frusto-conical housing can be provided between projector 74 and opening 78, although such is not shown.

Figure 6:
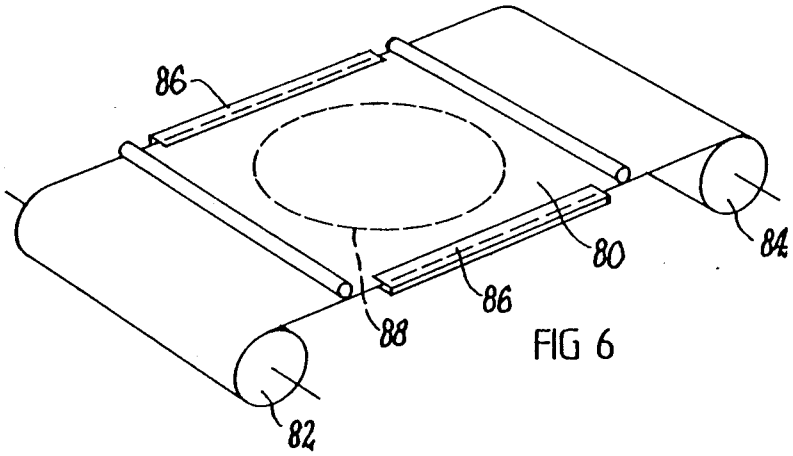
FIGS. 6 and 7 show detail of one form of screen.

With reference to FIG. 6, there is shown one form of screen suitable for use as screen 18 of FIG. 1 or screen 50 of FIGS. 3 or 4. In this screen, a length 80 of translucent film or fabric material is held taut between a supply roller 82 thereof and a take-up roller 84. Tensioning means (not shown) are operable on rollers 82,84 to maintain that tension longitudinally of length 80. Also, side edges of length 80 are held by respective clamps 86 which are drawn outwardly by tensioning means (not shown) to tension length 80 in a transverse direction.

The arrangement illustrated is mounted such that a central portion of length 80 provides the required screen 18,50. The respective tensioning means act to hold that portion taut and substantially flat. However, the portion may be further tensioned by a support ring 88 therebelow, and downwardly biased tension rollers 90 below which length 80 passes.

The arrangement illustrated is such that if the screen portion of length 80 is soiled or damaged, a fresh length may be drawn from roller 82 by rotation of roller 84.

Figure 7:
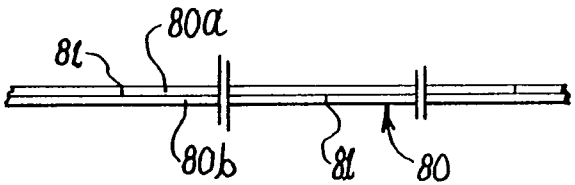

As shown in FIG. 7, the material to comprise length 80 may be formed of overlapping layers 80*a*, 80*b* of film or fabric for added strength or to achieve a required degree of translucency. As indicated by the overall scale implicit in each of FIGS. 1 to 4, the screen may be of substantial diameter, such as from forty to sixty feet. As film or sheet material of such width generally is not available, it may be formed from narrower widths by joining, or by overlapping and bonding two or more thicknesses. In either case, the effect of join lines 81 preferably is minimized to the maximum extent possible, such as by lines 81 in each of layers 80*a*, 80*b* being offset from each other.

Figure 9:
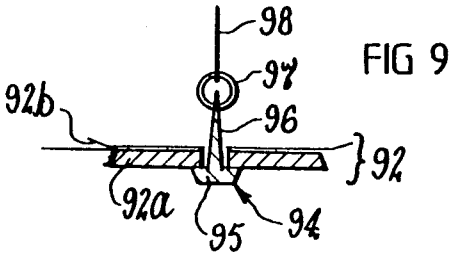
FIGS. 8 and 9 show detail of another form of screen, FIG. 9 being taken on line IX—IX of FIG. 8.
Figure 8:
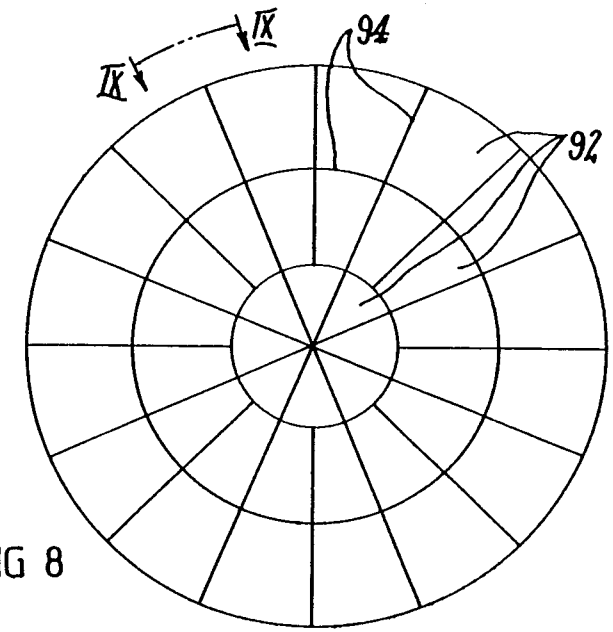

FIGS. 8 and 9 show an alternative form of screen. This is made up of a number of panels 92 of different configuration or size but which fit together in edge-to-edge relation to provide the required screen. The individual panels, of which three distinct forms are illustrated, may be formed of translucent sheet or, as depicted in FIG. 9, of transparent sheet having a covering of translucent film or fabric. In either case, the sheet material, at least in the sizes required, is such as to have sufficient stiffness as not to sag significantly when supported at its edges.

As shown in FIG. 9, the adjacent edges of circumferentially and radially adjacent panels 92 are supported by relatively rigid frame members 94, such as of extruded metal. The members 94 are interconnected, such as by welding, to define a skeletal frame structure corresponding to the network of adjacent panel edges as seen in FIG. 8. Each frame member 94 has a basal strip 95 which supports the respective edges of successively panels 92, and an upstanding fin 96 which projects between those edges. Fins 96 are relatively thin so as to minimise the spacing between adjacent edges. At least some fins are provided with at least one ring 97 by which the frame structure comprised of members 94 can be suspended by cables 98 to position the screen at a required level.

The assembly of panels 92 is such that, in the event of one or more being obscured or damaged by an object falling onto it, a panel can be removed and, if need be, replaced.

With reference to FIG. 10, the building 110 shown therein is suited to a front projection. Buidling 110 is at ground level, and has a frust-conical support or frame 112 which carries a spiral viewing platform or walkway 114 therein. Frame 112 extends below ground level and, across its base, there is provided a opaque and omnireflective screen 118 suitable for use with a front projection cinematic projector. Screen 118 is shown as comprising a horizontal display sheet of suitable material. If required, building 110 and any necessary excavation at its base can be modified to incorporate a rear projection screen of the form shown in FIGS. 6 and 7 or FIGS. 8 and 9.

Above screen 118, there is front projector system 121. The latter is mounted below a roof 113 closing the top of frame 112, above at least the major vertical extend of walkway 114. System 121 includes a projector 122, a snoot 123 and a baffle 125. Projector 122 is positioned so that its image cone 124 is projected vertically down onto screen 118. Snoot 123 is of circular horizontal section so as to extend fully around projector 122, and it extends below projector 122. Baffle 125 is mounted within snoot 123 and closes the latter below projector 122 apart from a central opening 127 in baffle 125 sufficient to enable cone 124 to emerge. The arrangement is such that cone 124, where it emerges from projector 122 is not visible to viewers at any position along walkway 114 while, at all such positions, viewers are able to see substantially the entire extent of screen 118 and images projected thereon; as shown by viewing angles $\theta'$, $\theta''$ for upper and lower viewing positions P', P'' respectively.

FIGS. 11 to 14 show a frame structure 130 suitable for use in a building or construction as shown in FIG. 1. Structure 130 is of skeletal form and is hexagonal in horizontal section.

Structure 130 includes six support posts 132 and, for each posts 132, a respective bracing member 134. Posts 132, at their lower ends, are mounted on pivots 136 secured to base 138 so that a pair of posts 132 can be raised in parallel relationship from a horizontal position as shown in the plan view of FIG. 11 and the side elevation of FIG. 12, to the vertical position shown in FIG. 13. The top end of each bracing member 134 is pivotally connected to the top of its post 132 at pivot 139, and has a roller 140 at its lower end.

With a pair of posts 132 in their horizontal position, the respective bracing members 134 also are horizontal and extend outwardly beyond posts 132, as shown in FIGS. 11 and 12. A cross bar 142 extends between the top of the pair of posts 132 so that, in conjunction with the respective pivots 136, the posts are secured in parallel relation. A similar cross-bar can be provided between members 134, such as adjacent rollers 140.

Each pair of posts 132 is raised in turn to its vertical position as shown in FIG. 12. As shown therein, a cable C is connected to cross-bar 142 and passes to a suitable pulling vehicle V, over a pivotable cable start support 144. As vehicle V moves from its position shown in solid line to successive positions to the right in FIG. 12, support 144 causes cable C to lift the top end of the pair of posts 132, with each post pivoting on its pivot 136, so that the posts are raised from their horizontal to their vertical position. Simultaneously, each roller 140 is drawn across the ground or support surface, with pivoting of each post 132 and its member 134 at the respective pivots 139. As the pair of posts 132 assume their vertical position, rollers 140 enter depressions in base 138, or are chocked, to hold the pair of posts in their vertical position. The other two pairs of posts 132 then are similarly raised.

Figure 13:
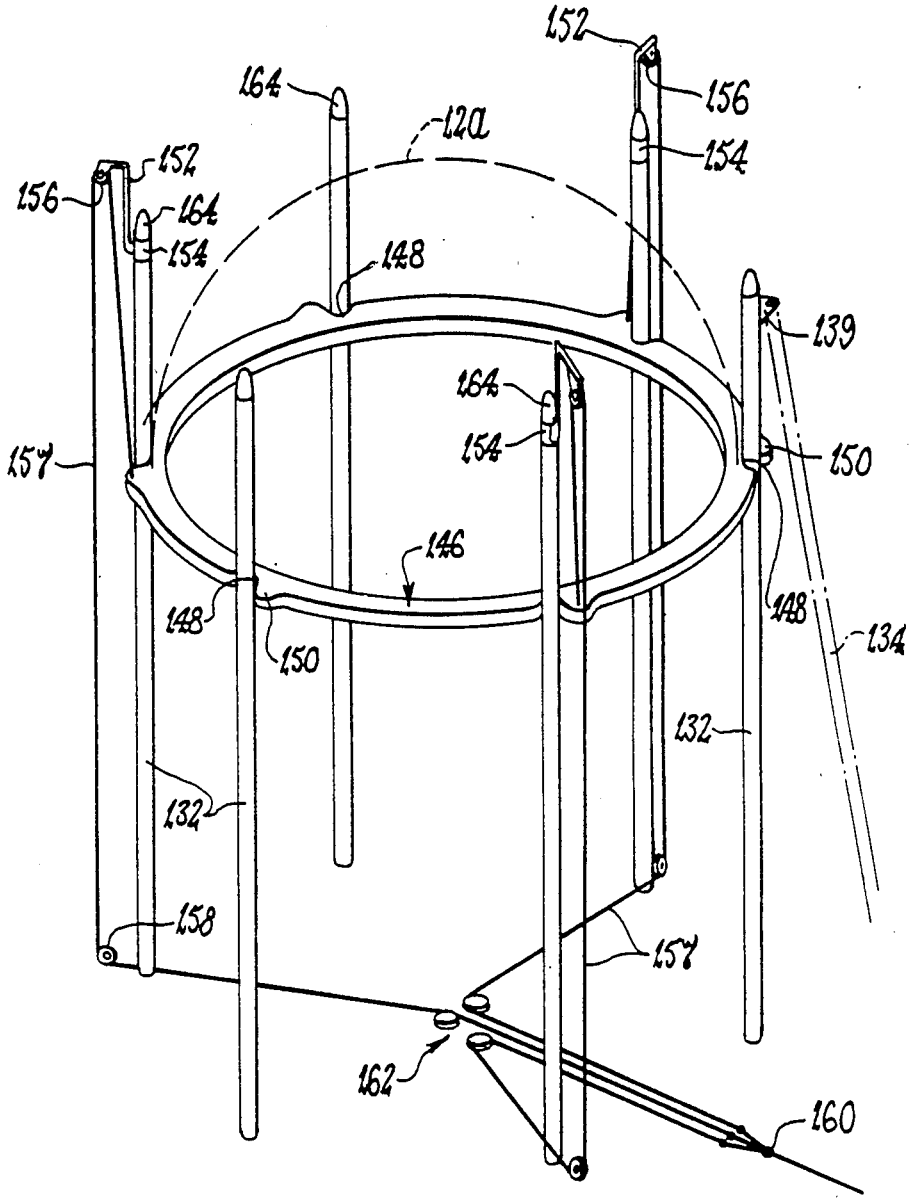
Figure 14:
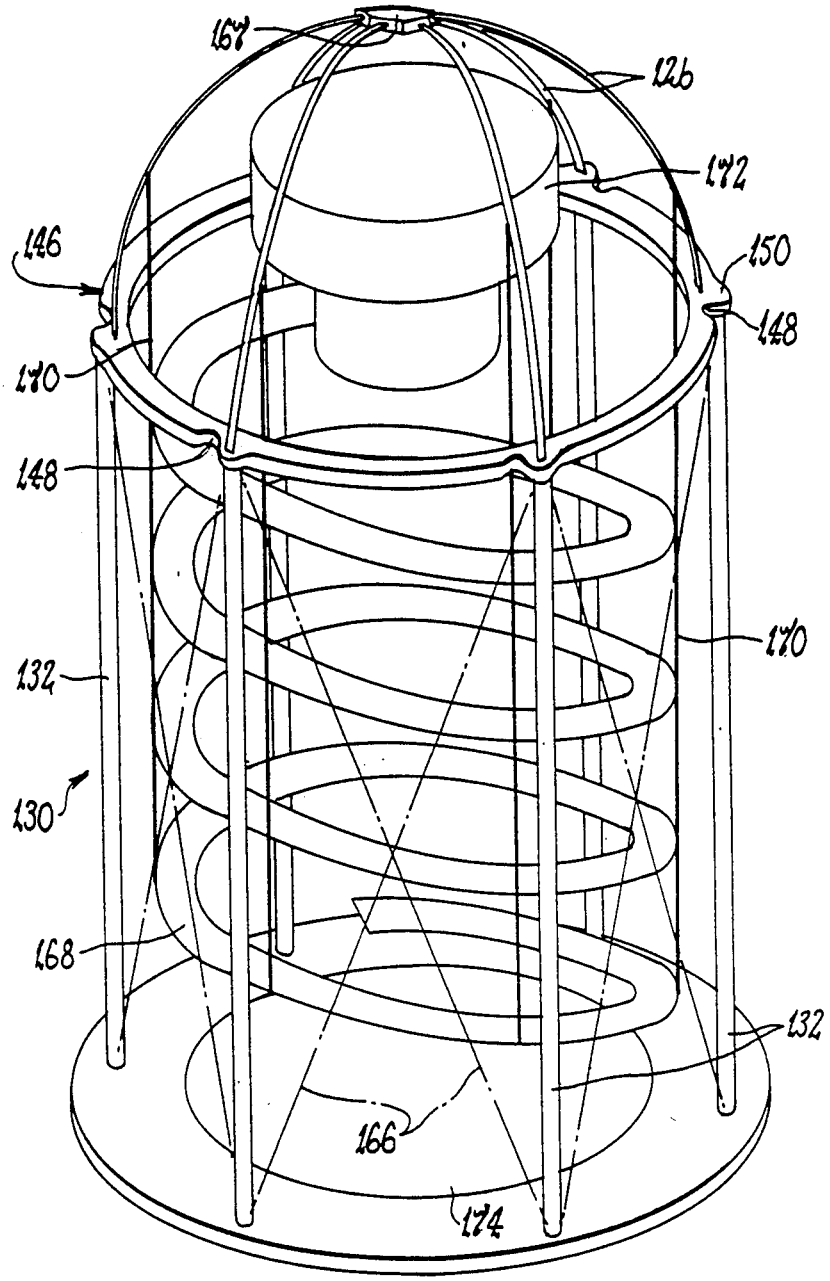

With all posts 132 are raised, a stabilizer ring 146 is then introduced within the posts and manipulated into a required horizontal initial position on base 138. At each of six locations, ring 146 is configured to provide on its outer circumference a radially inwardly extending pocket 148 and a radially outwardly extending projection 150. In the required initial positon for ring 146, each pocket 148 locates a respective post 132, while each projection is to the one side (the counter clockwise side as shown in FIG. 13) of a respective post 132.

Alternate posts 132 have a respective bracket 152 on this top end. As shown, each bracket has a vertical arm, by which it is mounted on the post by a respective thrust bearing 154, and a radially outwardly extending arm carrying a pulley 156. A respective cable 157 connected to a projection 150 passes over each pulley 156, around a lower pulley 158 to a coupling 160, via block and tackle cluster 162. Coupling 160 is connected to a pulling vehicle (not shown) to enable the vehicle to draw-out cables 157 and thereby raise ring 146 to the top of posts 132.

Respective pockets 148 provide clearance for each bracket 152 and its bearing 154 so that ring 146 can be raised slightly above the top of posts 132. Where above those posts, ring 146 is rotated slightly (clockwise in the view of FIG. 13) to locate each projection 150 over the top of its post 132; such rotation being enabled by rotation of each bracket 152 on its bearing 154. The tension applied to cables 156 then is released to enable a tapered cap member 164 on top of each post 132 to be received in a correspondingly shaped recess (not shown) in the under-surface of each projection 150.

Locations of cap members 164 within projections 150, and securement of rollers 140, provides a stable and strong structure. However, prior to the pairs of posts 132 being riased, diagonal wires or rods 166 are fitted to increase the overall stability and strength.

While reference is made above only to ring 146, the latter preferably is fitted (prior to it being raised) with a frame similar to frame 12 of FIG. 1. Such frame is shown in FIG. 13 in broken outline and identified by reference numberal 12*a*. Frame 12*a* preferably comprises three inverted U-shaped members 12*b*, with the ends of each secured to the top surface of diametrically opposed projections 150 and the central portions of the members inter-connected by a central boss or bolt 167. Frame 12*a* thus is raised with ring 146, by drawing cables 156.

With ring 146 is in position, helical walkway 168 is assembled within posts 132 and suspended from ring 146 and frame 12*a*. Suspension cables or rods 170 preferably are attached to frame 12*a* prior to that frame being raised on ring 146; the cables or rods 170 hanging down after ring 146 and frame 12*a* are raised. Walkway 168 is positioned within posts 132 and then lifted to a required position in which it is secured by cables or rods 170. The weight of the walkway (and viewers thereon) carried by frame 12*a* principally is transferred through posts 132 to base 138.

Structure 10 of FIG. 1 has projection from below screen 18, and a similar arrangement is possible with structure 130 as thus far described. For this, an opening would be provided in base 138, within posts 132, with a screen being provided within that opening and a projector system being housed within an excavation below base 138. However, structure 130, as further illustrated in FIG. 14, has a housing 172 within ring 146 and frame 12*a*, and raised with those components. The housing 172 contains a projector operable to project an image downwardly onto screen 174 on base 138.

When it has been erected as thus far described, structure 130 is covered by a suitable light excluding cover or skin (not shown). Such cover will enable access to the interior adjacent the lower end of walkway 168, to enable viewers for images projected onto screen 174 to move along the walkway to view the images from above.

Members 170 preferably are rods, and this preferment extends to either embodiments. Each rod 170 may define a hook or be provided with a pivotable coupling at one or both of its ends and by which it is secured to frame 12*a* and/or walkway 168. Such securement preferably allows limited movement of walkway 168, such as in a swaying movement, which serves to heighten viewers perception of an image projected onto screen 174.

Screen 174, in the arrangement of FIGS. 11 to 14, may be defined by a formed surface of base 138, or a member provided on base 138. Screen 174 may be defined by a smooth concrete surface. In FIGS. 11 to 14, screen 174 may be planar, or it may have a concave or convex viewing surface, and these variants apply to all other embodiments. A concave surface can heighten the viewer's perception of the preferred form of projected image. Such heightened perception also can occur with a convex viewing surface, but to a lesser extent. The prime advantage of the convex surface is that is readily can be washed and drained, such as by an array of sprays provided therearound.

Finally, it is to be understood that various alterations, modifications and/or additions may be introduced into the constructions and arrangements of parts previously described without departing from the spirit or ambit of the invention. Such variations are not to be regarded as a departure from the spirit and scope of the invention, and all such modifications as would be obvious to one skilled in the art are intended to be included within the scope of the following claims.

The claims defining the invention are as follows:

I claim:

1. An entertainment or amusement structure comprising:

a frame extending upwardly from a base;

an enclosure housing said frame;

a horizontally disposed cinema screen mounted in a lower portion of said enclosure, said screen having images projected thereon; and an elongated movable walkway suspended from said frame, said walkway being located in an upper portion of said enclosure and extending circumferential around said screen and being located above said screen for permitting viewers on said walkway to see said screen; and means for moving said walkway in a controlled manner, the viewers on said walkway generally experiencing an increased feeling of realism of the images on said screen in response to movement of said walkway.

2. The structure as defined in claim 1, wherein the frame structure is an integral part of said enclosure.

3. The structure as defined in claim 1, wherein the frame is structurally independent of said enclosure.

4. The structure as defined in claim 3, wherein said walkway extends circumferentially fully around said screen.

5. The structure as defined in claim 1, wherein at least a portion of said walkway is of an elongated arcuate form extending around the screen to enable viewers thereon to move for viewing images projected onto the screen from different angles.

6. The structure as defined in claim 5, wherein said walkway is of helical form.

7. The structure as defined in claim 1, wherein said means for moving said walkway comprises at least one of ropes, cables and rods secured to the frame and suspending said walkway therefrom.

8. The structure as defined in claim 7, wherein said at least one of ropes, rods and cables allows a controlled amount of movement of the walkway as the viewers walk along said walkway.

9. The structure as defined in claim 1, further comprising a projector mounted below said screen and adapted to generate said images on said screen by one of direct projection and reflected rear projection.

10. The structure as defined in claim 9, wherein said structure at least above said screen is enclosed to an extent that viewers on said walkway are substantially isolated from light external to said structure, the structure below said screen having a housing which isolates a cone of image light generated by said projector from the external light.

11. The structure as defined in claim 1, further comprising a projector mounted above said screen and adapted to generate said images on said screen by front projection.

12. The structure as defined in claim 1, wherein said structure is enclosed at least to an extent that viewers on said walkway are substantially isolated from light external to said structure.

13. The structure as defined in claim 1, wherein said screen comprises a portion of a film or sheet material, said portion being disposed between a supply roll of the material and a take-up roll such that, as required, a further portion of the material can be used as the screen by drawing the material from the supply roll to the take-up roll.

14. The structure as defined in claim 1, wherein said screen is defined by a plurality of panels fitted in edge-to-edge relation and said structure further comprises means for supporting said panels in edge-to-edge relation.

15. The structure as defined in claim 14, wherein said means for supporting enables replacement of said panels.

* * * * *